US006079599A

United States Patent [19]

Nordstrom et al.

[11] Patent Number: 6,079,599

[45] **Date of Patent: *Jun. 27, 2000**

[54] COMBINATION BACKPACK AND SEAT CUSHION

[76] Inventors: Roger L. Nordstrom; Frances A. Nordstrom, both of 10549 17th Ave., Lemoore, Calif. 93245

[ * ] Notice: This patent issued on a continued prosecution application filed under 37 CFR 1.53(d), and is subject to the twenty year patent term provisions of 35 U.S.C. 154(a)(2).

[21] Appl. No.: 09/041,925

[22] Filed: Mar. 13, 1998

[51] Int. Cl.[7] ..... A45F 4/02

[52] U.S. Cl. ..... 224/153; 224/155; 224/275; 297/188.12

[58] Field of Search ..... 224/575, 577, 224/155, 153, 578, 579, 580, 275, 627, 651, 652, 653, 654, 657, 235; D12/416; 297/188.13, 188.12, 188.08, 219.1, 228.1

[56] References Cited

U.S. PATENT DOCUMENTS

| | | | |
|---|---|---|---|
| D. 308,916 | 7/1990 | Dinham | D12/416 |
| D. 371,108 | 6/1996 | Baker | D12/416 |
| 2,843,185 | 7/1958 | Clem et al. | 224/155 X |
| 2,865,433 | 12/1958 | Warner | 190/8 X |
| 3,515,430 | 6/1970 | Nelson | 297/228.1 X |
| 4,003,508 | 1/1977 | Hoops | 224/275 |
| 4,597,605 | 7/1986 | Gilbert | 297/228.1 |
| 4,655,343 | 4/1987 | Lane et al. | 224/153 X |
| 4,799,731 | 1/1989 | Brown | 297/188.13 X |
| 4,854,637 | 8/1989 | McCree | 297/188 |
| 4,856,570 | 8/1989 | Rushing et al. | 224/153 X |
| 4,925,064 | 5/1990 | Comora | 224/155 |
| 4,925,241 | 5/1990 | Geraci | 297/219.1 |
| 5,025,965 | 6/1991 | Smith | 224/579 X |
| 5,172,838 | 12/1992 | Rowell et al. | 190/103 X |
| 5,405,068 | 4/1995 | Lovett | 224/153 |
| 5,431,265 | 7/1995 | Yoo | 190/103 |
| 5,573,155 | 11/1996 | Sadler | 224/155 |
| 5,573,288 | 11/1996 | Raffensperger | 297/188.12 |
| 5,584,422 | 12/1996 | Bond-Madsen | 224/155 |
| 5,588,570 | 12/1996 | Zirbel | 224/155 |
| 5,641,199 | 6/1997 | Bond-Madsen | 297/229 |
| 5,816,463 | 10/1998 | Echeverri | 224/577 X |
| 5,894,977 | 4/1999 | Krueger et al. | 224/153 X |

FOREIGN PATENT DOCUMENTS

| | | | |
|---|---|---|---|
| 1101785 | 10/1955 | France | 190/103 |
| 2604251 A1 | 8/1976 | Germany | 297/219.1 |

*Primary Examiner*—Gregory M. Vidovich
*Attorney, Agent, or Firm*—Fliesler Dubb Meyer & Lovejoy LLP

[57] ABSTRACT

The combination backpack and cushion device comprises a padded member which is placed on top of a stadium seat and a compartment member which extends horizontally below the seat. The device includes a sleeve member which is placed over a stadium seat and interconnects the padded member and compartment. The device is secured to the seat by an adjustable securing member which holds the sleeve member in a mating relationship with the seat. The device includes pockets for storage of articles and is carried to an event by adjustable backpack straps.

23 Claims, 19 Drawing Sheets

COMBINATION BACKPACK AND SEAT CUSHION

BACKGROUND OF THE INVENTION

1. Field of the Invention

The present invention is directed toward the field of portable seat cushions and storage devices, and more particularly to a backpack with an integrated seat device which is used to transport articles to a spectator event and then used as a cushion device during the event.

2. Art Background

It is common for people attending spectator events to carry personal articles to the event in order to make the event more enjoyable. These articles may include food, programs, wallets, sun protection lotion, glasses, binoculars, cameras, warm clothes, and blankets as well as other miscellaneous items. Furthermore, spectators are often required to sit for long periods of time while watching the sporting event. Since stadium seats are often hard and uncomfortable, a spectator may desire to bring a cushion in an effort to provide comfortable sitting for extended hours.

In the past, some designers have attempted to deal with this problem by providing a portable seat cover that may be carried to a spectator event and laid on top of the seat. The seat cover included a storage pouch which usually hung down in front of the seat adjacent to a users legs. Although this combination seat cushion, backpack carrying device was accessible to the spectator during the event, the placement of the device could interfere with the spectators freedom of movement and also with other people who were walking by. Furthermore, because of the placement and limited size of the storage compartment, it often was not big enough to hold all of a spectators personal articles, such as the articles mentioned previously. Moreover, some combination seat cushion and storage compartment devices were placed on a seat without adequate securement of the device to the seat. When a spectator stood up and down, the device might not remain stationary.

Other prior art seat cushion-tote bag devices are unfoldable into a seat cover and include internal pouches for carrying liquid refreshments. Although the devices may not have had the problem of interfering with a spectator's or other person's freedom of movement, the devices had the disadvantage that the devices must be carried with one hand. This reduced the availability of the user's hands for other more important needs. Some devices with a shoulder strap were not designed to keep the storage compartment away from the front of a person, and thus could interfere with the person's activities while the device was being transported to and from a sporting event. Furthermore, the device's pouch was not big enough to hold all of the user's desired articles.

SUMMARY OF THE INVENTION

It is therefore an advantage of this invention to provide a combination backpack and seat cushion device which is capable of transporting articles in one or more compartments, and also can be quickly and easily converted into a comfortable seating device usable for prolonged sitting periods.

Another advantage of this invention is to provide a combination backpack and seat device which can be secured to a stadium type seat or bleacher.

A further advantage of this invention is to provide a combination backpack and seat device wherein securement is on the seat sides which is easily accessible as compared to on the back of the seat which is cumbersome and awkward.

Another advantage of this invention is to provide a combination backpack and seat cushion device which will not substantially interfere with the freedom of movement of a user's legs or interfere with people walking in front of the seat.

Yet another advantage of this invention is to provide a combination backpack device wherein the articles stored under the seat are not damaged due to contact with spilled liquids on the ground.

A still further advantage of this invention is to provide a combination backpack and seat cushion device which is lightweight and functions comfortably as a backpack and carrying device.

Another advantage of this invention is to provide a combination backpack and seat cushion device which is adjustable to various seat dimensions.

Yet another advantage of this invention is to provide a combination backpack and seat cushion device which frees both hands and arms of a user as the user proceeds to and from an event.

A still further advantage of the invention is to provide a combination backpack and seat cushion device which is economical, easy to use, and waterproof. These and other advantages of the invention will become obvious upon further investigation.

In accordance with the present invention a new and improved combination backpack and seat cushion device is provided. A spectator can easily carry and transport many articles to an event in a single compartment. Also, the device can be attached and detached easily to any stadium seat or bleacher. The combination backpack and cushion device comprises a padded member which is placed on top of a stadium seat and a compartment member which extends below the seat. The device includes a sleeve member which is placed over a stadium seat and interconnects the padded member and compartment.

In another aspect of the invention, the device is secured to the seat by an adjustable securing member which holds the sleeve member in a mating relationship with the seat.

In a further aspect, the device is carried to an event by adjustable backpack straps which affords the user maximum degree of freedom and comfort.

In another embodiment, the device is attached and detached to a bleacher and includes a panel which is placed in proximity with the front of the bleacher and interconnects the compartment member and the padded member. The device of the second embodiment is secured to the bleacher by an adjustable securing member provided on the back of the device. Similarly, the device is carried to an event by adjustable backpack straps.

BRIEF DESCRIPTION OF THE DRAWINGS

The above and other advantages of the present invention will be apparent upon consideration of the following detailed description, taken in conjunction with the accompanying drawings, in which like reference characters refer to like parts throughout, and in which.

DETAILED DESCRIPTION OF THE PREFERRED EMBODIMENTS

The present invention in general relates to portable seat cushions and storage devices which are transported to spectator events and includes a novel way for attaching the device to a stadium seat or bleacher. It is understood that the principles of present invention may be suitable for a variety of functions and incorporated into backpacks used when hiking, hunting, biking, or other events.

Figure 1:
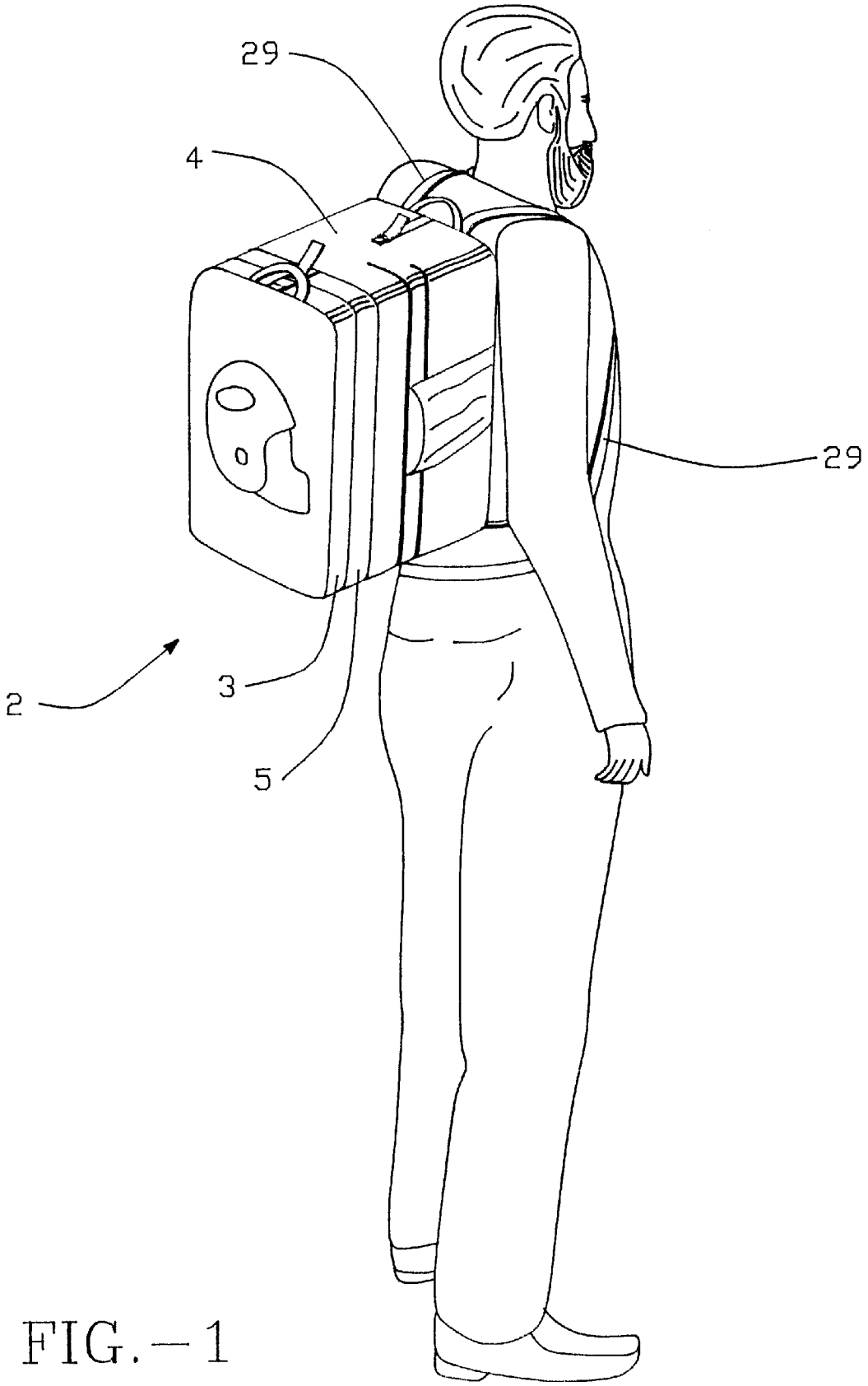
FIG. 1 is a perspective view of an embodiment of the present invention in the backpack configuration in place on the back of a user.
Figure 11:
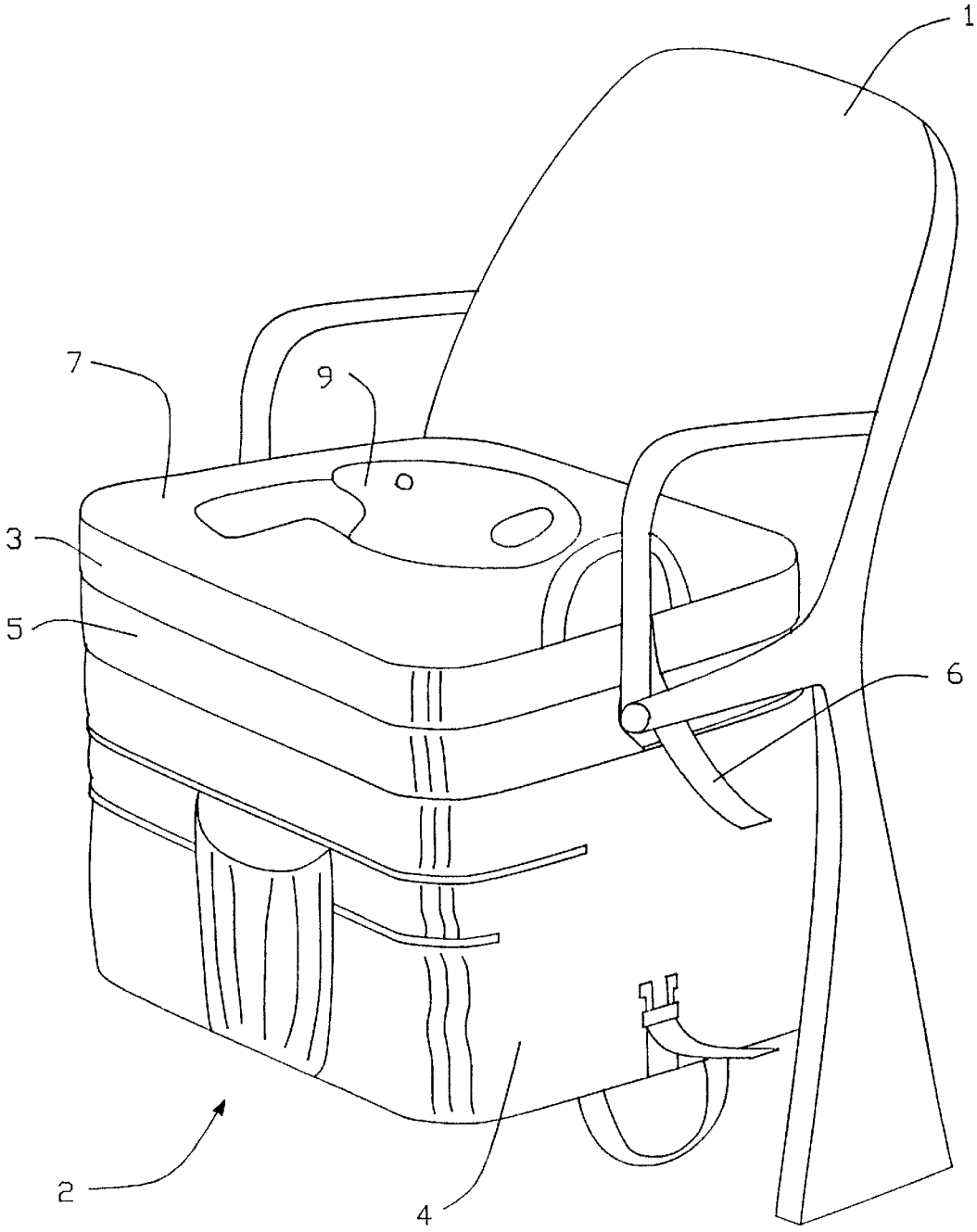
FIG. 11 is a perspective view of the embodiment of FIG. 1 showing the device secured to a seat.

Referring to the drawings, FIGS. 1 and 11 depict a combination backpack and cushion device (2). The device (2) includes a padded member (3) which covers the top of a seat (1) and provides comfort to a user during a spectator event, a compartment member (4) that extends below the seat for holding articles, and a sleeve member (5) which couples the padded member (3) and the compartment member (4) to the seat. The device further includes a securing member (6) which is connected to the padded member (3) and the compartment member (4) and holds the sleeve member (5) in a mating relationship with the seat.

Figure 2:
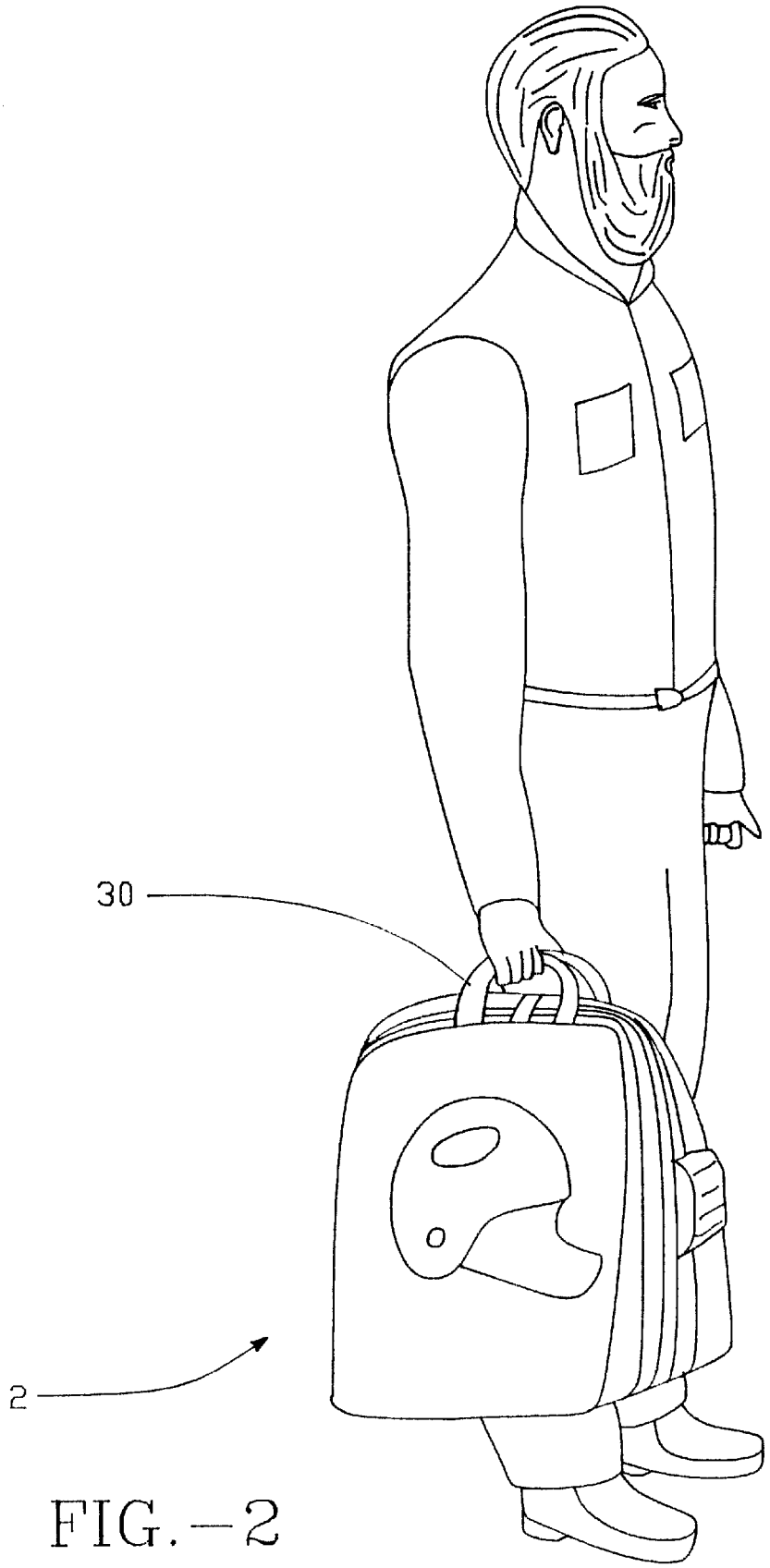
FIG. 2 is a perspective view of the embodiment of FIG. 1 wherein the strap handles are being used.
Figure 3:
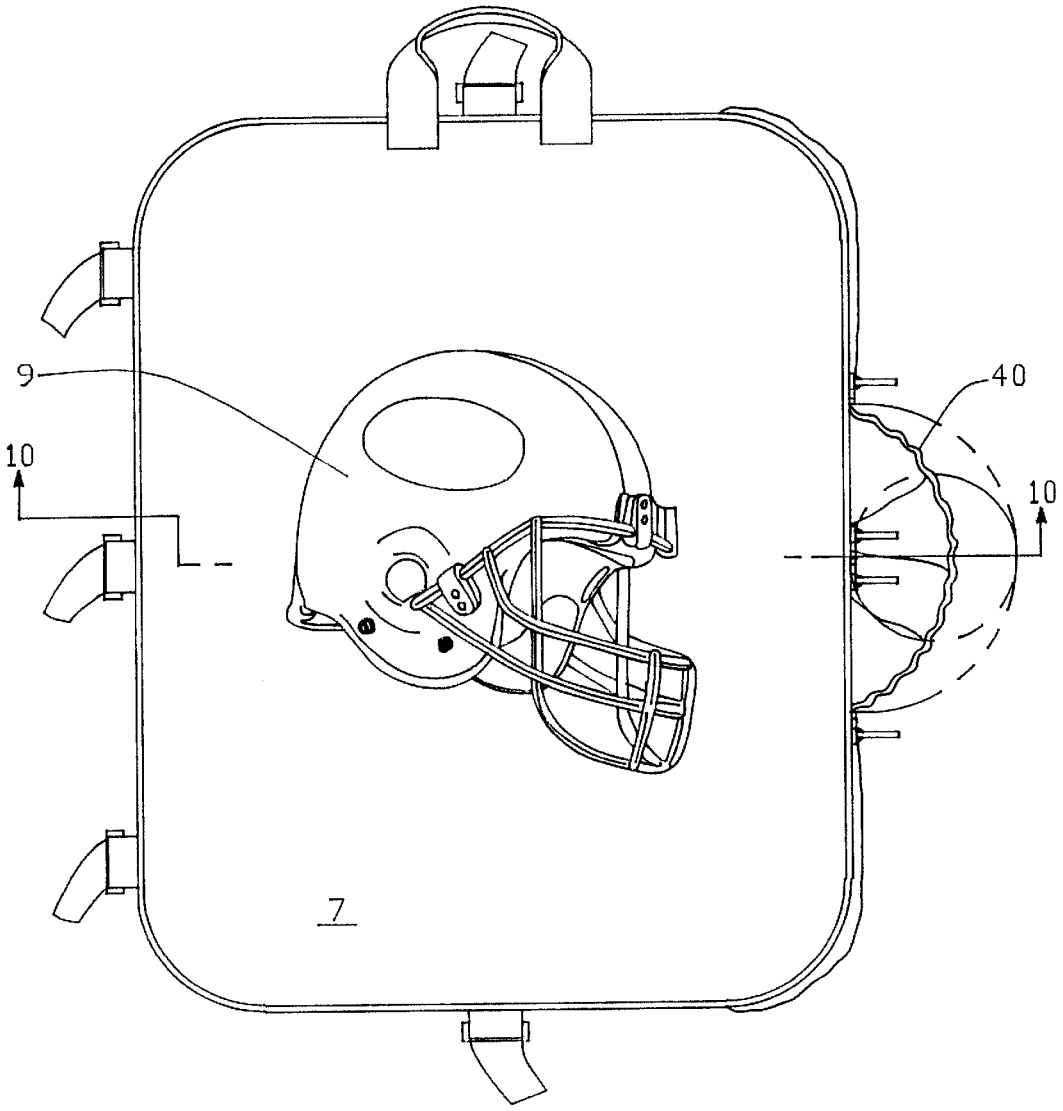
FIG. 3 is a top view of the embodiment of FIG. 1 showing a sports logo attached to the padded member.
Figure 12:
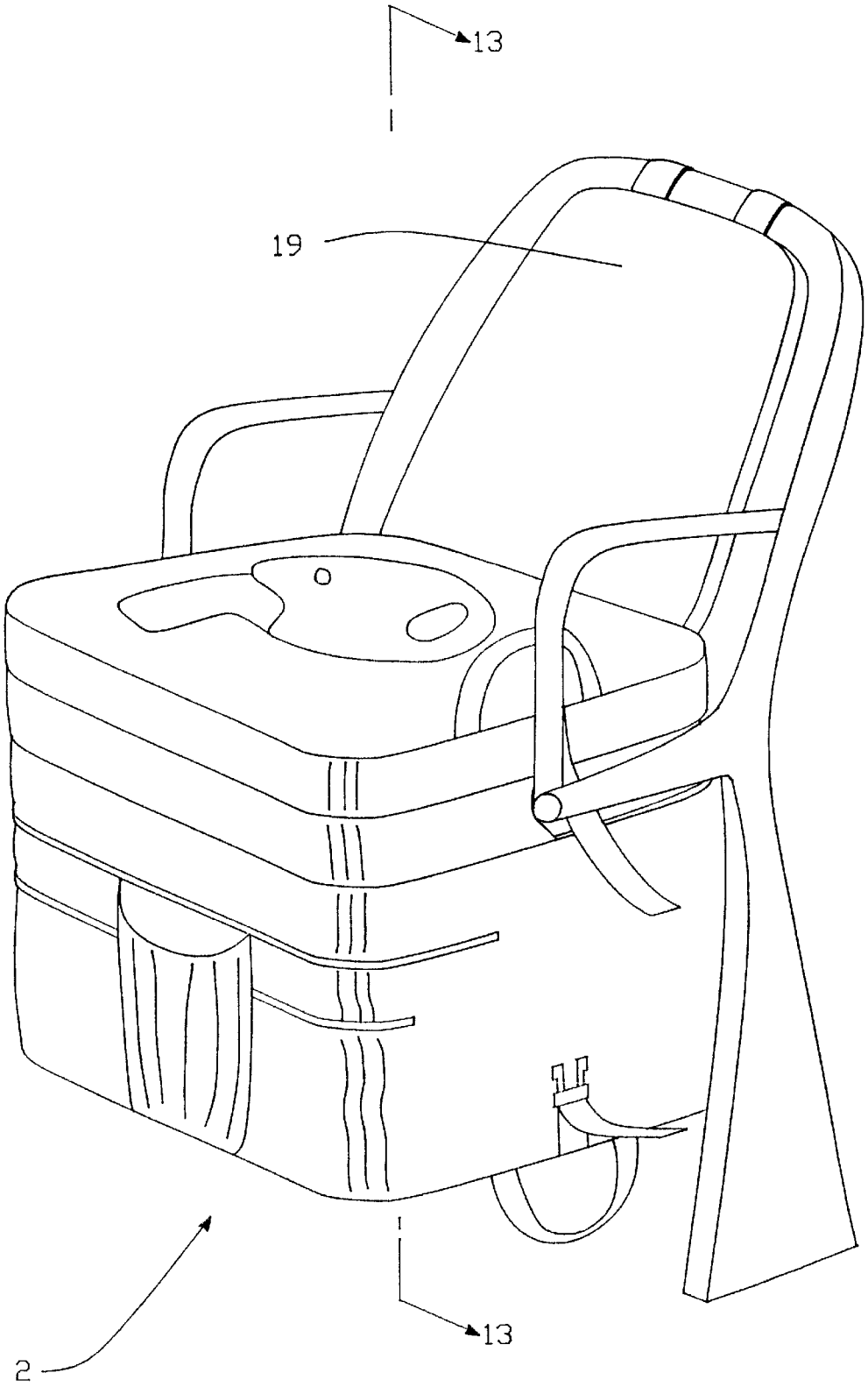
FIG. 12 is a perspective view of the embodiment of FIG. 1 showing the device having a padded back member extended up and secured to a seat.
Figure 13:
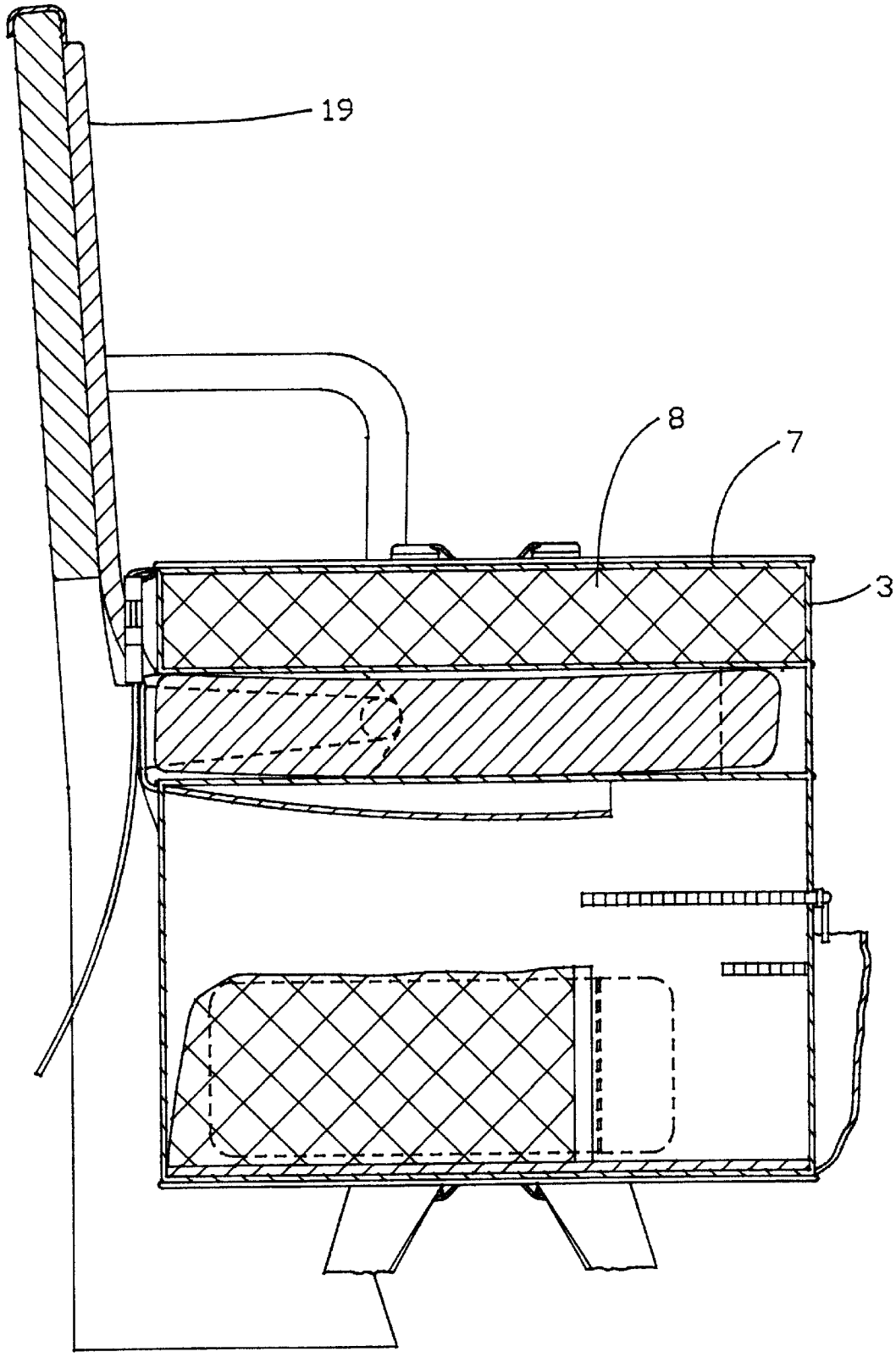
FIG. 13 is a cross-sectional side view of the embodiment of FIG. 1 through line 13—13 of FIG. 12 showing the device having a padded back extended up and secured to a seat.

With reference now to FIGS. 11 and 13, the padded member (3) covers the entire surface of a standard stadium seat and includes a top portion (7) which the user sits on during the spectator event. The padded member (3) should be made of a durable water resistant material, such as nylon, so that the user may sit on a warm and dry surface. The cushion (8), which comprises the inside material of padded member (3), should be made of a foam-like resilient material which provides cushioned support during the spectator event. The preferred thickness of the cushion is 2.5 inches, although the thickness may be varied dependent upon the desired firmness of the padded member (3). Furthermore, a team logo print (9) can be applied to the top portion (7) of the padded member (3) as shown in FIGS. 1–3. In addition, as illustrated in FIGS. 12 and 13, the device may include a padded back member (19) which is extended up and used as cushion for a user's back. While in transport, the padded back member (19) may be folded down and stored interposed between the padded member (3) and the compartment member (4).

The compartment member (4) as illustrated in FIGS. 5–11, comprises a front portion (10), a back portion (11), a top portion (12), a bottom portion (13), and two side portions (14, 15), all portions defining a storage compartment for storing articles. The compartment member (4) is made of a heavy duty material, such as nylon, which is the same material as the padded member (3). The depth of the compartment member (4) is preferably 9 inches but can range from 3 inches to 10 inches. The compartment member is preferably 16 inches wide and 16 inches from front to back of the device (2). The compartment member (4) has an opening (16) which allows for access to the articles inside the compartment member (4). The compartment member (4) is opened and closed with a zipper which extends the full length of the front portion (10) and part way down the two side portions (14, 15). A double access zipper may be provided so that the compartment member (4) may be more easily opened. Within the compartment member (4), there is a wall member (18) which lies against the bottom portion (13) of the compartment member. The wall member (18) supports the articles in the compartment member (4) when it is extended in a horizontal position below the seat so that the sagging of the compartment member due to the weight of the articles is limited. Furthermore, the wall member (18) prevents rubbing and generalized discomfort to the user from contact with odd shaped articles while the device is being transported, thereby providing complete protection to the back of the user. The compartment member (4) also includes adjustable buckles, shoulder straps, and pockets, as will be described below in more detail.

Referring specifically to FIGS. 7–9 and 11, a sleeve member (5) is provided which is designed to be placed over the seat. The sleeve member (5) is a slip-cover type seat fastener and couples the padded member (3) and the compartment member (4) to each other on the front and on both sides of the device (2). Because the sleeve member (5) slides over the seat, it also prevents the device from falling off of the seat and onto the ground when the user stands up and down.

Figure 9:
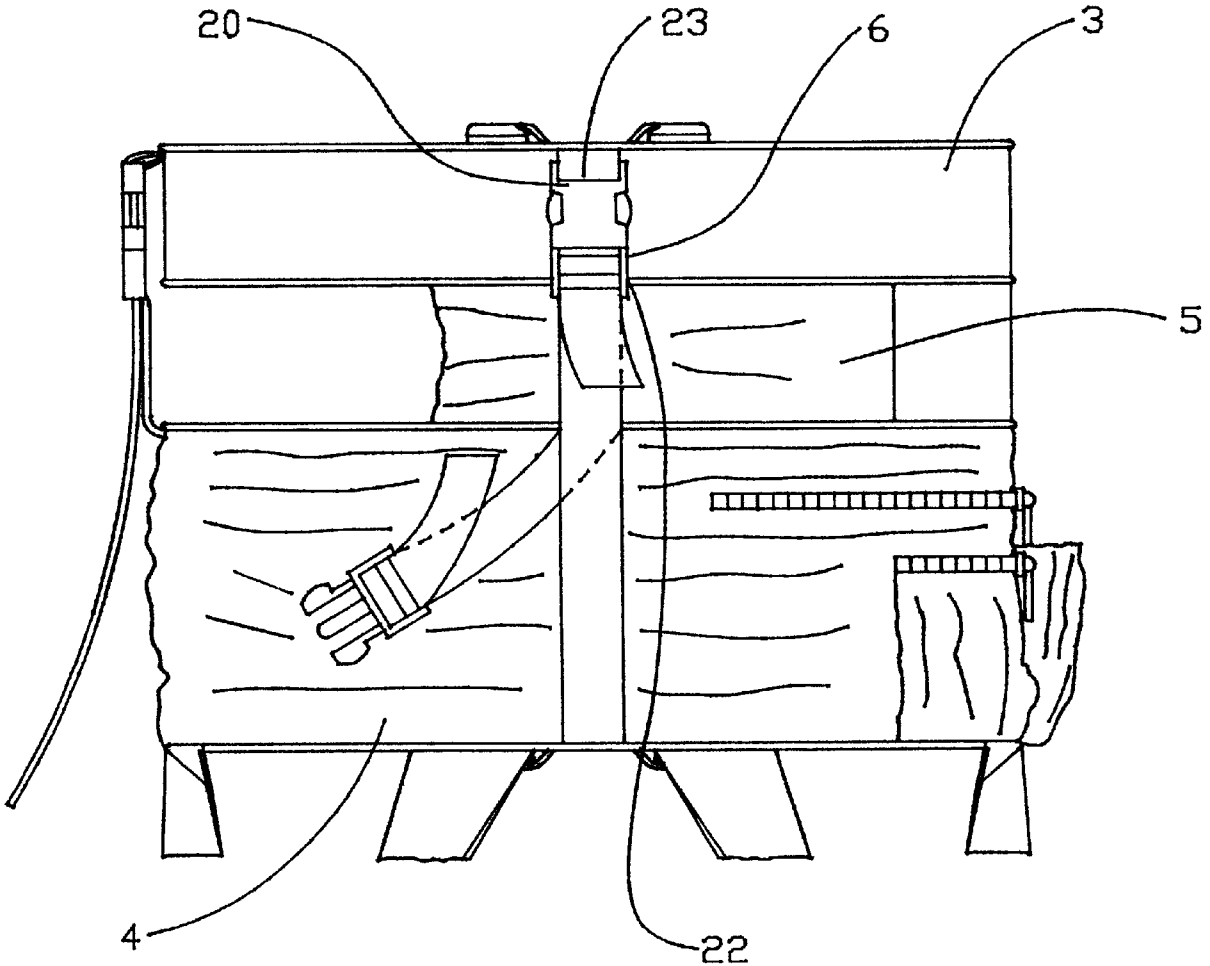
FIG. 9 is a side view of the embodiment of FIG. 1 showing the device in the cinched embodiment.

With reference now to FIGS. 5–9 and 11, the combination backpack and cushion device also includes a securing member (6) which holds the sleeve member (5) in a mating relationship with the seat. The securing member (6) is connected to the padded member (3) and the top of the compartment member (4) and releasably secures the device (2) to the seat. The securing member (6) is adjacent to the sides of the seat and includes a plurality of adjustable buckles (20) which allow the device to accommodate various seat dimensions. The securement of the device on the sides of the seat is preferred since it is more accessible by the user as compared to other methods. Moreover, securement of the device (2) on the side of the seat allows for adaption to various seat thicknesses and sizes. In addition, the device may also be secured at the back of the seat if desired by adjustable buckles (20A) as depicted on FIGS. 6–8. The adjustable buckles (20) are shown to include short straps (21) which end with quick release buckles for quick mounting on and off of the seat. The device also includes a second set of quick release buckles (22) attached to the very bottom of the compartment member (4). The second set of quick release buckles (22) attach to the padded member buckles (23) and serve to hold the device in a cinched position, as shown in FIG. 9. These buckles (22) are used when the backpack is being carried on a user's back to and from the activity and are desired because the compartment member (4) can be expanded to the desired width needed for storage of the articles.

Figure 5:
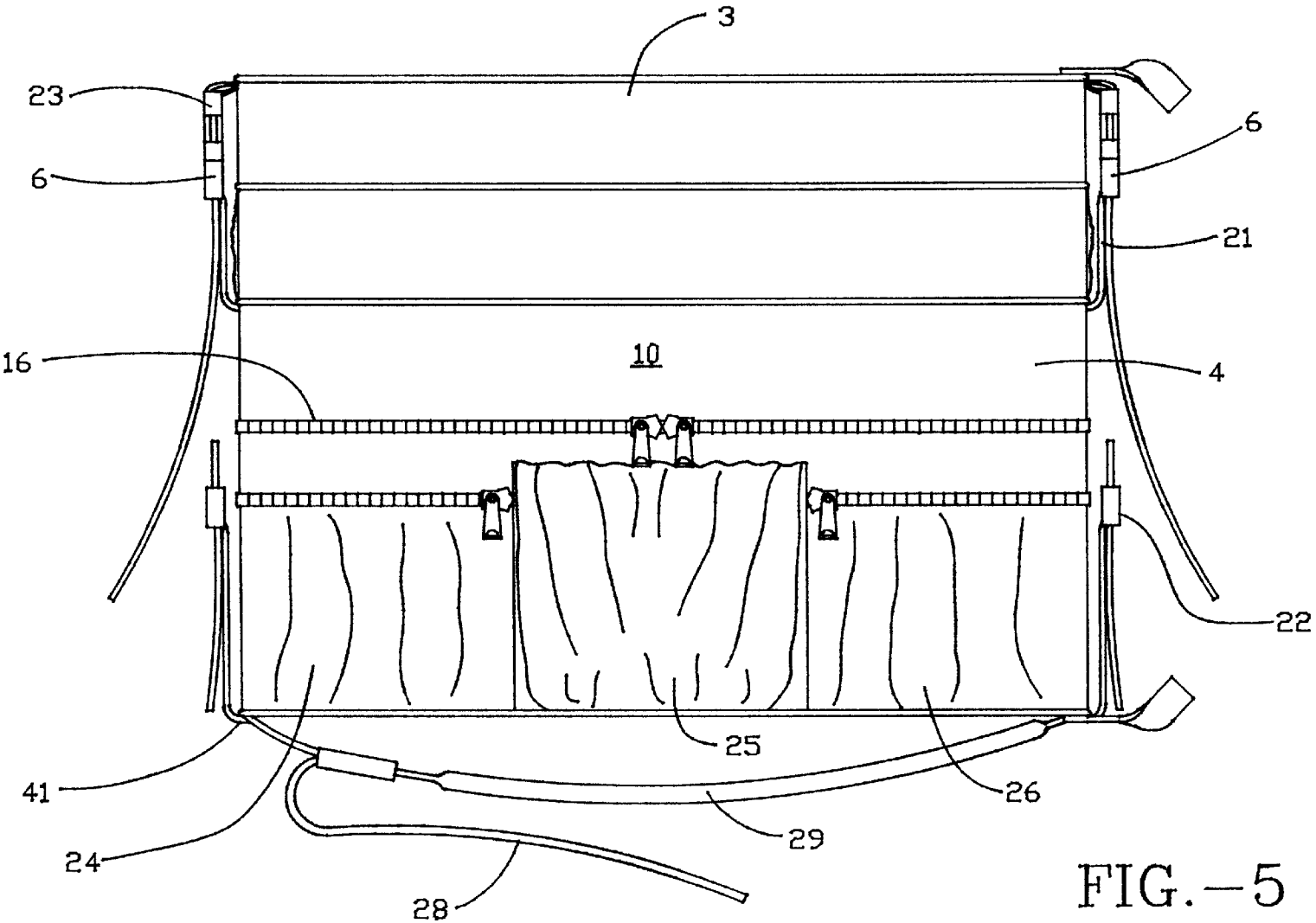
FIG. 5 is a front view of the embodiment of FIG. 1 showing the holding members.
Figure 6:
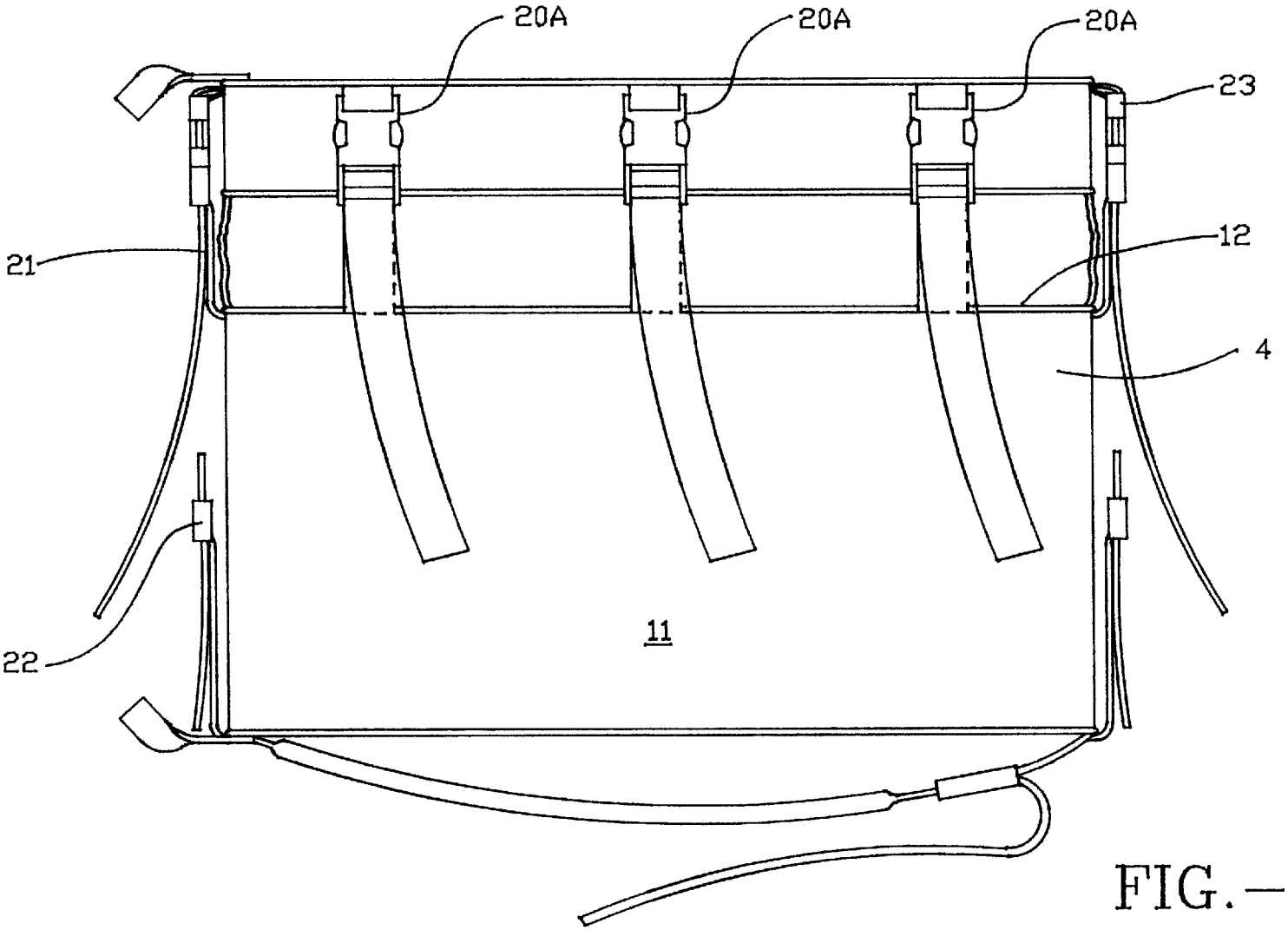
FIG. 6 is a back view of the embodiment of FIG. 1 showing the additional securing member.
Figure 7:
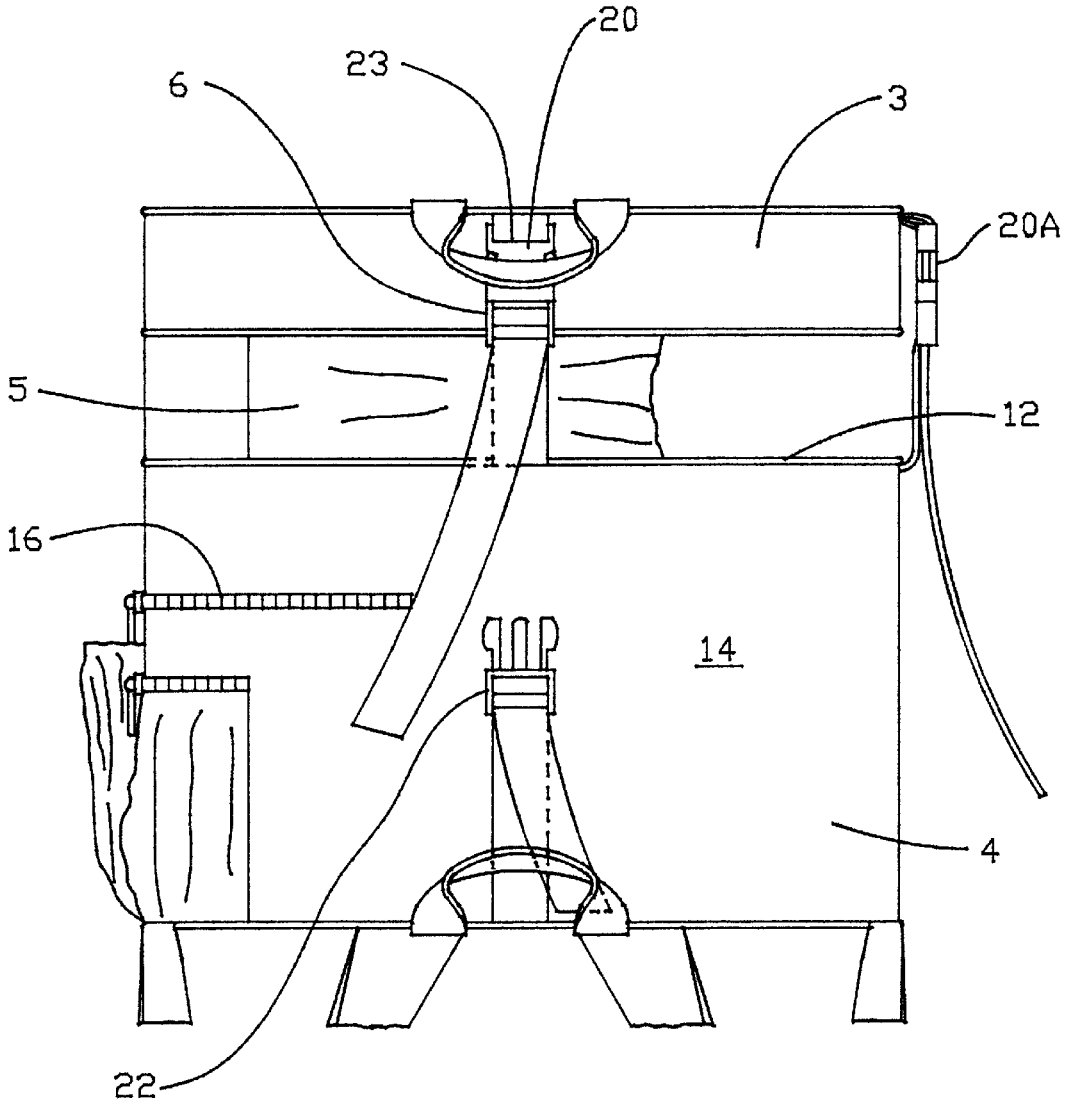
FIG. 7 is a side view of the embodiment of FIG. 1 showing the device secured to a seat.
Figure 8:
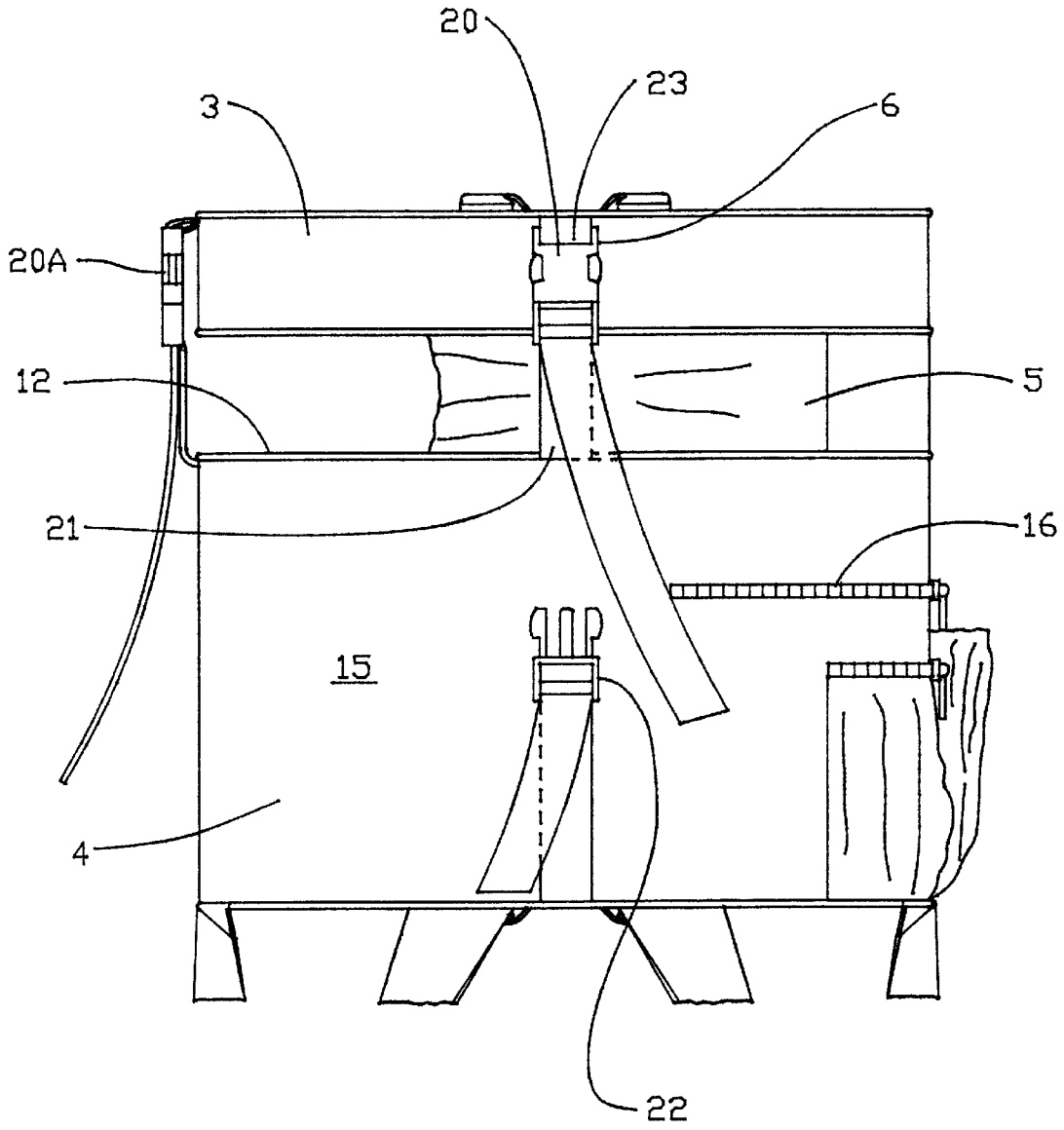
FIG. 8 is the other side of the embodiment of FIG. 1 showing the device secured to a seat.
Figure 10:
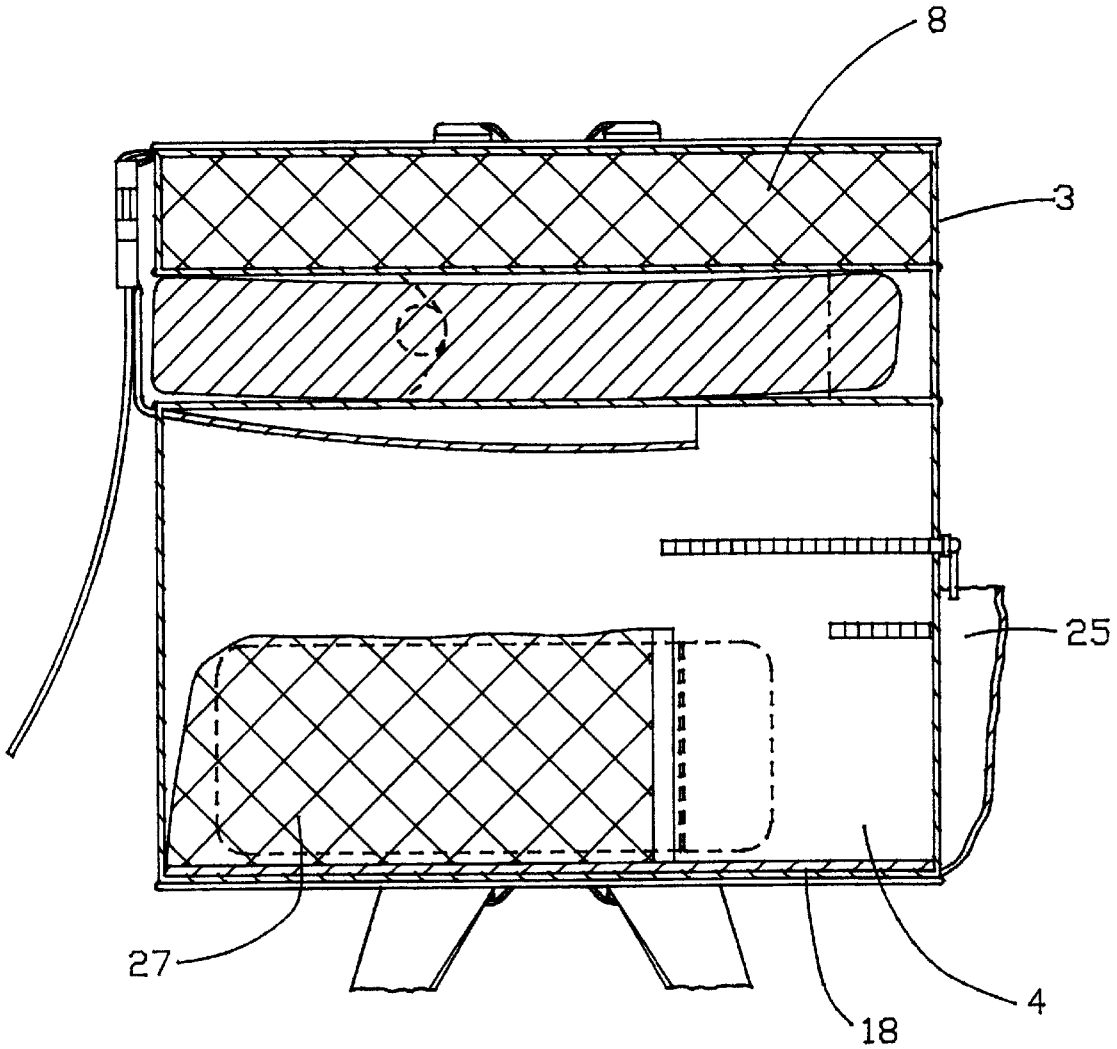
FIG. 10 is a cross-sectional side view of the embodiment of FIG. 1 through line 10—10 depicted in FIG. 3 showing the device secured to a seat.

With reference now to FIGS. 5 and 10, the details of the holding members (24, 25, 26, 27) will be discussed. In the preferred embodiment, the device of the present invention includes four holding members (24, 25, 26, 27), but many more holding members may be provided, shaped and configured to contain various specific articles. The holding members comprise three pockets (24, 25, 26) positioned on the front portion (10) of the compartment member (4) and one inside pocket (27) positioned on the interior of the compartment member (4). All three pockets (24, 25, 26) include an open end for facilitating access to the pockets. The two outermost pockets (24, 26) have zippers for selective closure of the pocket. The outermost pockets (24, 26) may be smaller and are suitable for holding articles, such as keys, snacks, money or a wallet. The innermost pocket (25) has an elastic member (40) which holds the pocket closed in a cinched relationship, as shown in FIG. 3. The innermost pocket (25) may be made of a mesh material and is suitable for holding cups or soda cans of different sizes. The device further includes an inside pocket (27) on the interior of the compartment member (4) as seen in FIG. 13. The inside pocket (27) also includes an opening and can be utilized when holding bigger sized articles, such as a blanket or jacket.

Figure 4:
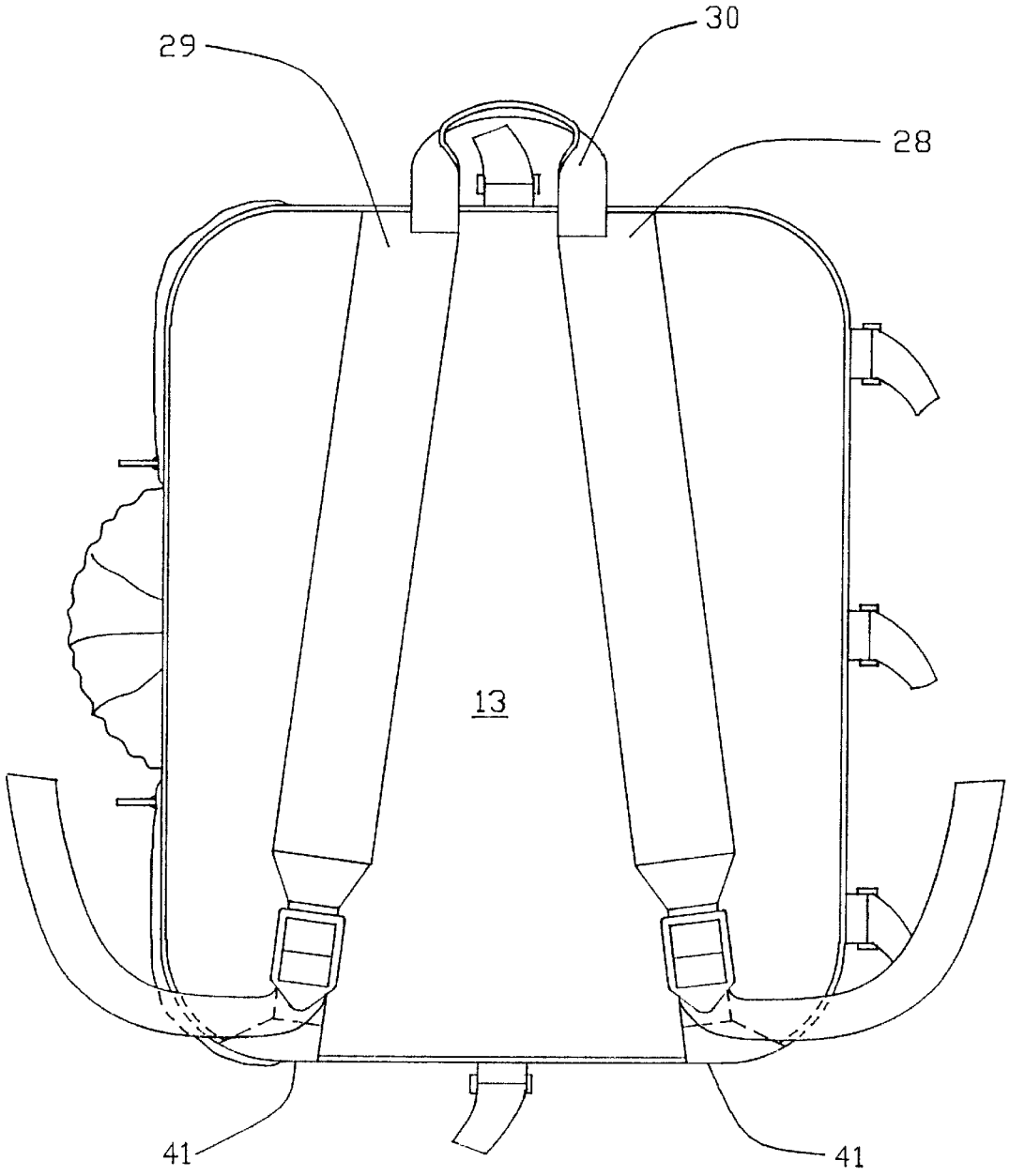
FIG. 4 is a bottom view of the embodiment of FIG. 1 showing the carrying member.

The carrying member (28), as illustrated in FIGS. 4 and 5, comprises two adjustable backpack straps (29) attached to the bottom of the compartment member (4). The backpack straps (29) extend from one side of the bottom of the compartment member, loop over the shoulders of the user, and then down around under the arms to secure to the other side of the bottom of the compartment member at connection points (41) shown in FIG. 4. The backpack straps (29) are adjustable and provided so that the device can be carried compactly as a backpack allowing freedom of the user's hands for other important tasks, such as holding stair rails or a child's hand. Moreover, the device can further include two strap handles (30) which enable the combination backpack and cushion device to be carried by a user's hand if desired, as shown in FIG. 2.

Figure 14:
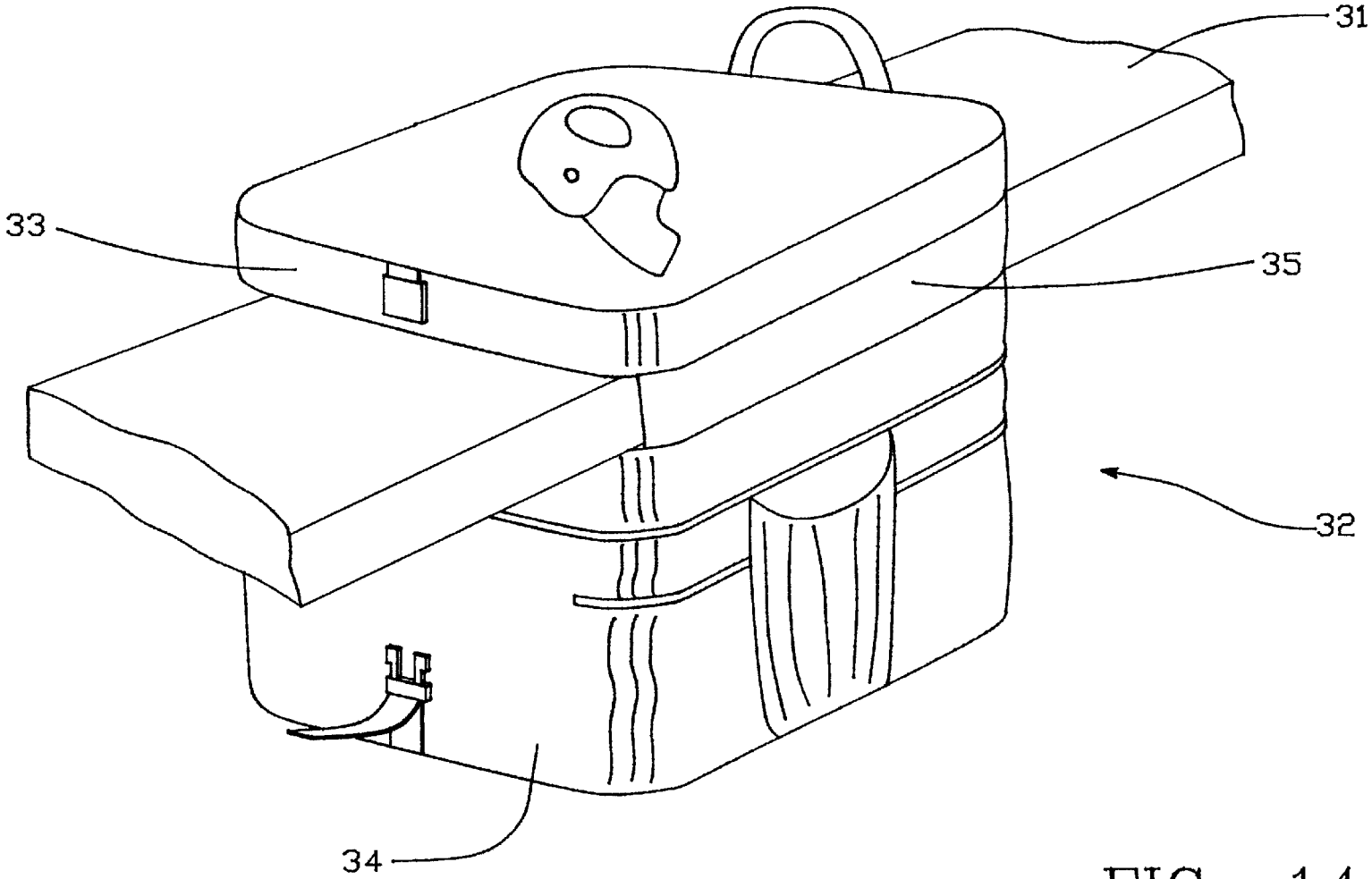
FIG. 14 is a perspective view of an alternate embodiment of the present invention showing the device secured to a bleacher.
Figure 15:
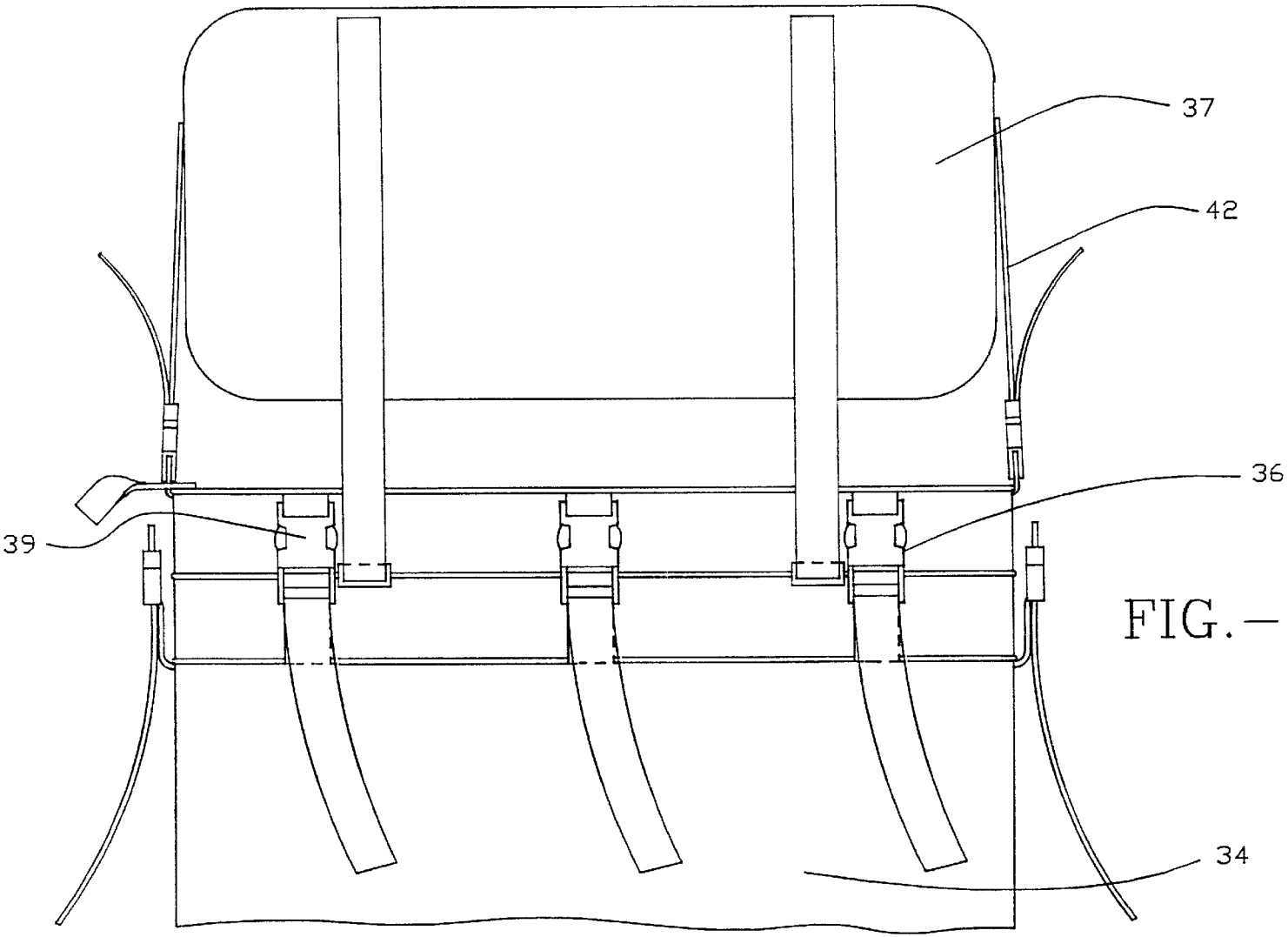
FIG. 15 is a back view of the alternate embodiment of FIG. 14 showing the back member extended up.
Figure 16:
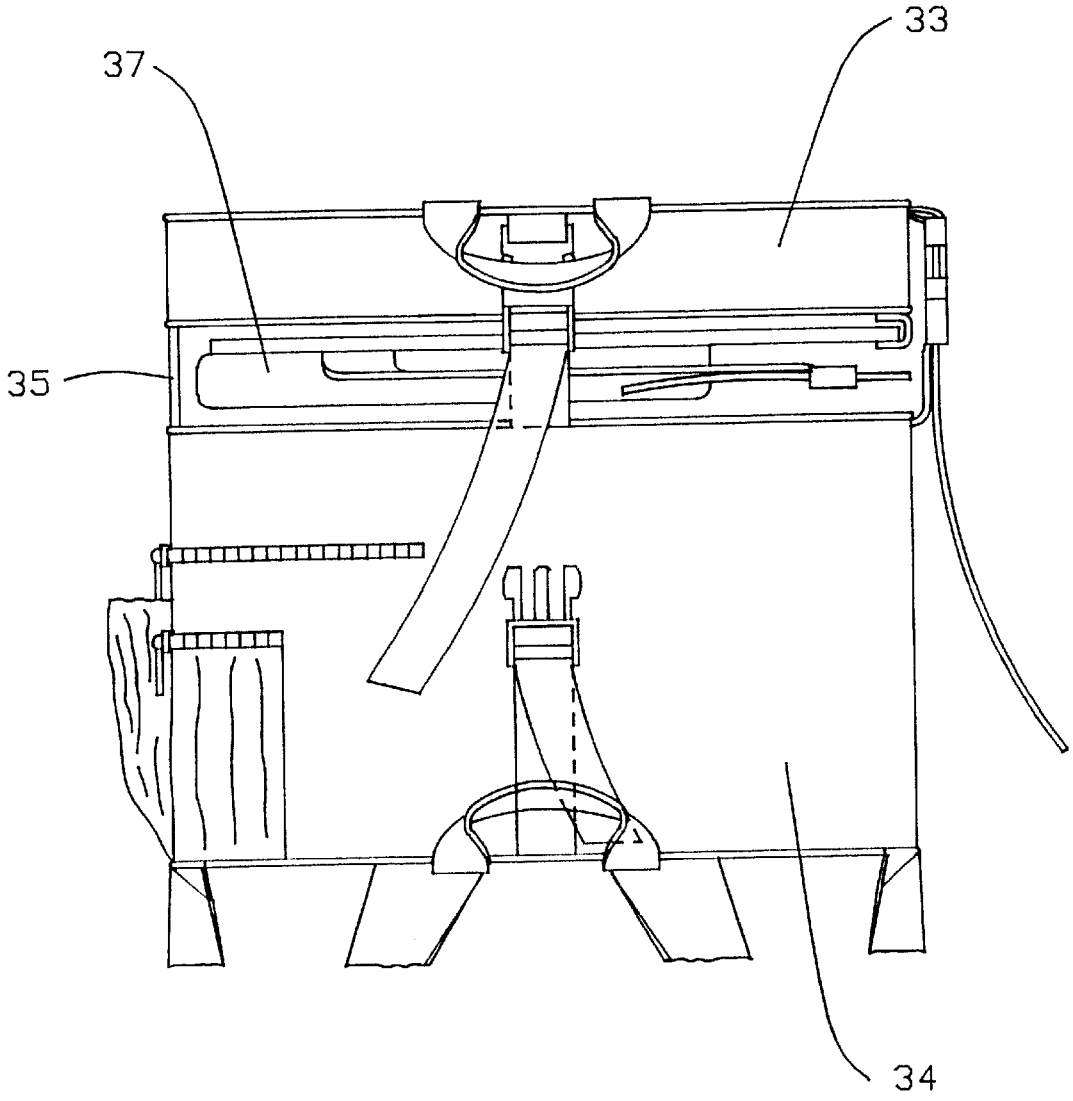
FIG. 16 is a side view of the alternate embodiment of FIG. 14 showing the back member in its carrying position.
Figure 17:
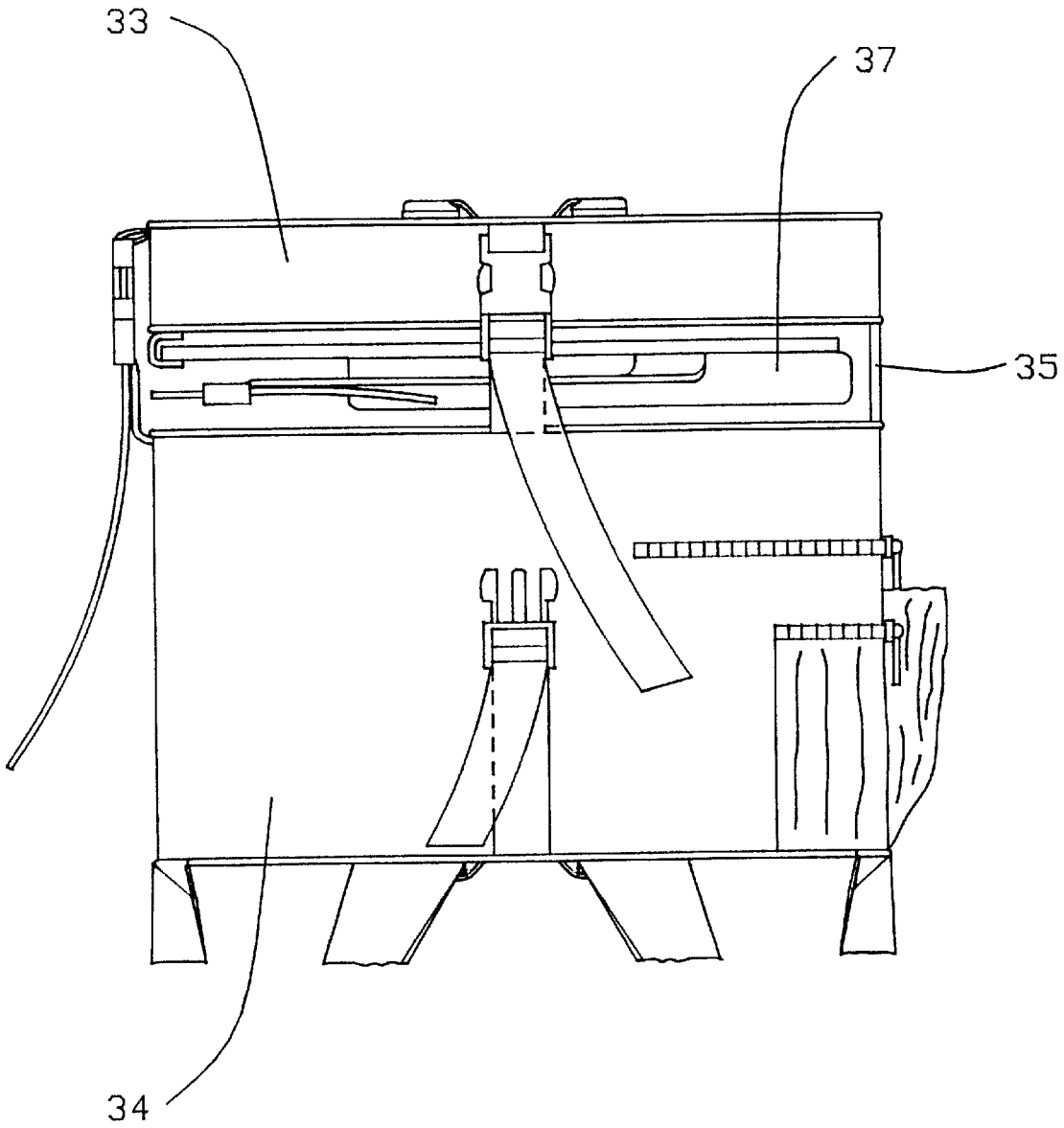
FIG. 17 is the other side view of the alternate embodiment of FIG. 14 showing the back member in its carrying position.
Figure 18:
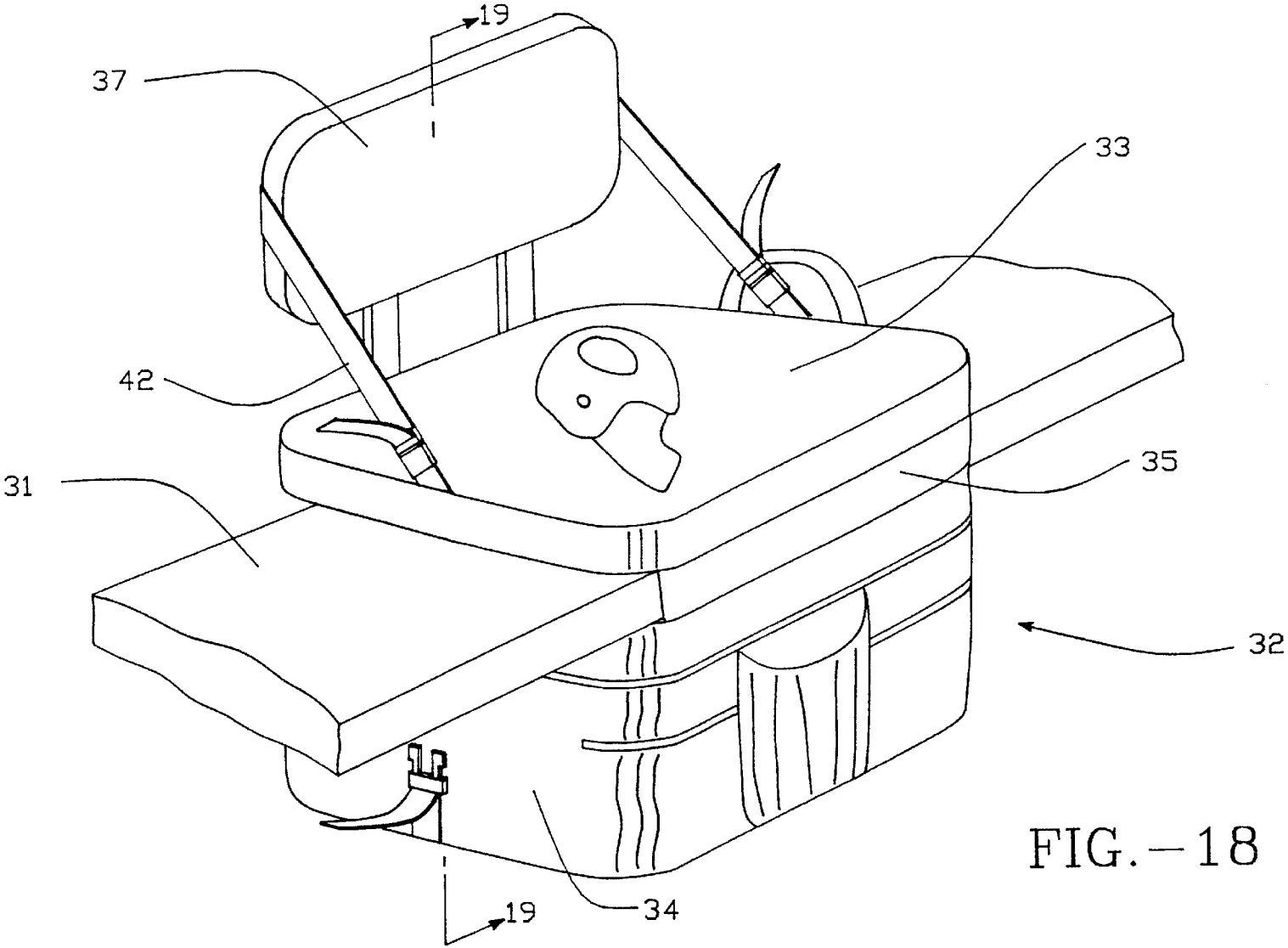
FIG. 18 is a perspective view of the alternate embodiment of FIG. 14 showing the device with the back member extended up.
Figure 19:
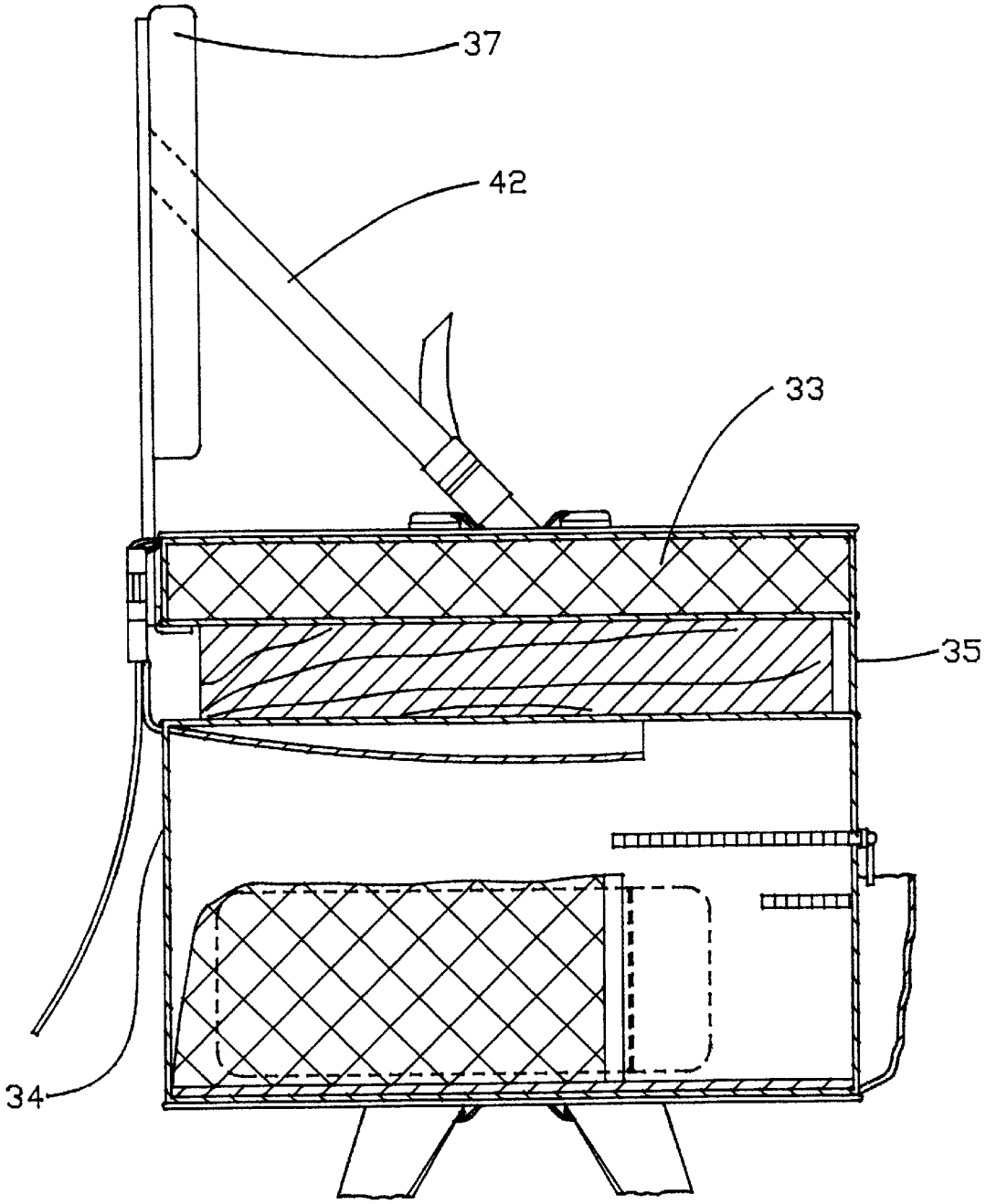
FIG. 19 is a cross-sectional side view through line 19—19 of FIG. 18 of the alternate embodiment of FIG. 14 showing the back member extended up and the interior holding members.

In a second embodiment illustrated in FIG. 14, the combination backpack and cushion device (32) is used on a bleacher (31) at a spectator event. The second embodiment comprises the same padded member (33) and compartment member (34) as shown in the first embodiment in FIG. 11. In this embodiment, the connecting member is a panel (35) which couples the compartment member (34) and padded member (33) on the front side of the device and is placed in proximity with the front of the seat. The padded member (33) is placed on top of the bleacher and the compartment member (34) is extended below the bleacher such that the front panel (35) touches the front of the bleacher. Securing means (36) are provided on the back of the bleacher and include adjustable buckles (39) as shown in FIG. 15. In addition, the second embodiment may include a back member (37) which is extended up and secured by strap (42). The back member (37) supports a user's upper and lower back in situations where the bleacher has no back, as shown in FIGS. 18 and 19. Furthermore, the back member may include padding for added comfort to the user. While in transport, the back member (37) preferably may be folded down and stored interposed between the padded member (33) and the compartment member (34) as shown in FIGS. 16 and 17.

As will be understood from the previous discussion, the device is transported to an event in the above-described cinch position as illustrated in FIG. 9. When the user arrives at the spectator event with the device in the cinched configuration, the adjustable buckles (22) located at the bottom of the compartment member (4, 34) are disconnected and the padded member (3, 33) is placed on top of the seat or bleacher. The device is placed adjacent the front of the seat allowing the compartment member (4, 34) to extend below the seat. The device is then secured on the seat sides with adjustable buckles (20) located at the top of the compartment member (4). Alternatively, in the second embodiment, the device is secured on the bleacher back with adjustable buckles (39). With the compartment member (4, 34) under the seat or bleacher, articles are protected from spectators who walk by, and does not interfere with the users legs. Furthermore, the device prevents the seat from moving up and down when the user stands up and down during the event.

Although the present invention has been described in terms of specific exemplary embodiments, it will be appreciated that various modifications and alterations might be made by those skilled in the art without departing from the spirit and scope of the invention.

What is claimed is:

1. A combination backpack and cushion device comprising:

a padded member that is adapted to cover a seat having upper and lower surfaces and lateral sides;

a compartment member that is adapted to extend below the seat;

said compartment member having a top portion, and an opposing bottom portion located distally from said top portion;

a sleeve member coupling the padded member to the top portion of said compartment member;

said sleeve member in combination with said padded member and said compartment member adapted to be placed over the seat including portions being in proximity with and adjacent to both the upper and lower surfaces and the lateral sides of the seat in order to hold the device on the seat such that said padded member covers the upper surface of the seat and said compartment member extends below the seat; and a means secured to said bottom portion of said compartment member adapted for carrying the device on the back of an individual.

2. The combination backpack and cushion device of claim 1, including a securing member connected to said padded member and said compartment member which holds said sleeve member in a mating relationship with the lateral sides of the seat.

3. The combination backpack and cushion device of claim 2, wherein said securing member includes a plurality of adjustable buckles which allow said combination backpack and cushion device to accommodate various seat dimensions.

4. The combination backpack and cushion device of claim 1, further including at least one holding member connected to said compartment member which stores articles in said combination backpack and cushion device.

5. The combination backpack and cushion device of claim 1, including at least one holding member which comprises a pocket having an opening at one end, said opening including an elastic member which provides access to the articles in sad pocket.

6. The combination backpack and cushion device of claim 1, wherein said carrying means includes a carrying member which is adapted to transport said combination backpack and cushion device to and from an event.

7. The combination backpack and cushion device of claim 6, wherein said carrying member comprises two straps which is to be placed on two shoulders of a user.

8. The combination backpack and cushion device of claim 1, wherein said compartment member has an opening at one end, said opening including a member which provides access to articles in said compartment member.

9. The combination backpack and cushion device of claim 1, further comprising a sports logo attached to a top side of said combination backpack and cushion device.

10. The combination backpack and cushion device of claim 1, further including a securing means for holding said combination backpack and cushion device in an adjustable cinched position.

11. The combination backpack and cushion device of claim 1, further including a plurality of adjustable buckles for securing the device at a back of the seat.

12. The combination backpack and cushion device comprising:

a padded means for covering a seat and providing comfort to a user during sitting periods;

a compartment means extending below the seat for holding articles carried to an event;

said compartment having a top portion, and an opposing bottom portion located distally from said top portion;

said sleeve means coupling said padded means to said top portion of said compartment means;

said sleeve means in combination with said padded means and said compartment means for placement over the seat including portions being in proximity with and adjacent to lateral sides of the seat in order to hold the device on the seat such that said padded means covers the seat and said compartment means extends below the seat; and a means secured to said bottom portion of said compartment means adapted for carrying the device on the back of an individual.

13. The combination backpack and cushion device of claim 12, including a securing means connected to said padded means and said compartment means which holds said sleeve means in an adjustable mating relationship with the lateral sides of the seat.

14. The combination backpack and cushion device of claim 12, further including a plurality of adjustable buckles for securing the device at a back of the seat.

15. A combination backpack and cushion device comprising:

a carrying member adapted for carrying the device on the back of an individual;

a compartment member with a top portion, and an opposing bottom portion located distally from said top portion, and with said bottom member secured to said carrying member;

a padded member; and a connecting member which couples said top portion of said compartment member and said padded member, said connecting member comprising a sleeve which in combination with the compartment member and the padded member are adapted to be placed over a seat including portions being in proximity with and adjacent to a seat top, a seat bottom and lateral sides of the seat such that said padded member covers the seat top and said compartment member extends below the seat.

16. The combination backpack and cushion device of claim 15, wherein said carrying member comprises one strap for placement on one shoulder of a user.

17. The combination backpack and cushion device of claim 15, wherein said carrying member comprises two straps for placement on two shoulders of a user.

18. The combination backpack and cushion device of claim 17, further including a second carrying member comprising two handles which enable said combination backpack and cushion device to be carried by a user's hand.

19. The combination backpack and cushion device of claim 15, further including a plurality of adjustable buckles for securing the device at a back of the seat.

20. The combination backpack and cushion device of claim 15, including a securing member connected to said padded member and said compartment member which holds said sleeve in a mating relationship with the lateral sides of the seat.

21. A combination backpack and cushion device comprising:

a padded member that is adapted to cover a seat having upper and lower surfaces and lateral sides;

a compartment member that is adapted to extend below the seat, said compartment member having a top portion and an opposing bottom portion located distally from said top portion, and a carrying member that is adapted for allowing the device to be carried on the back of a person, which carrying member is secured to said bottom portion of said compartment means;

a sleeve member coupling the padded member to the top portion of the compartment member;

said sleeve member in combination with said padded member and said compartment member adapted to be placed over the seat including portions being in proximity with and adjacent to both upper and lower surfaces and lateral sides of the seat in order to hold the device on the seat such that said padded member covers the upper surface of the seat and said compartment member extends below the seat; and a securing member connected to said padded member and said compartment member which holds the sleeve member in a mating relationship with the lateral sides of the seat.

22. The combination backpack and cushion device comprising:

a padded means for covering a seat and providing comfort to a user during sitting periods;

a compartment means extending below the seat for holding articles carried to an event, said compartment member having a top portion, and an opposing bottom portion located distally from said top portion, and a carrying member for carrying the device on the back of a person secured to said bottom portion of said compartment means;

said sleeve means coupling said padded means to said compartment means;

said sleeve means in combination with said padded means and said top portion of the compartment means for placement over the seat including portions being in proximity with and adjacent to lateral sides of the seat in order to hold the device on the seat such that said padded means covers the seat and said compartment means extends below the seat; and a securing means connected to said padded means and said compartment means which holds the sleeve means in an adjusting mating relationship with the lateral sides of the seat.

23. A combination backpack and cushion device comprising:

a carrying member;

a compartment member having a top portion and an opposing bottom portion located distally from said top portion, said bottom portion secured to said carrying member wherein said carrying member configured for securing the device on the back of a person;

a padded member; and a connecting member which couples said top portion of said compartment member and said padded member, said connecting member comprising a sleeve which in combination with the compartment member and the padded member are adapted to be placed over a seat including portions being in proximity with and adjacent to a seat top, a seat bottom and lateral sides of the seat such that said padded member covers the seat top and said compartment member extends below the seat; and a securing member connected to said padded member and said compartment member which holds the sleeve member in a mating relationship with the lateral sides of the seat.

* * * * *